US006105478A

United States Patent [19]

Cestonaro et al.

[11] Patent Number: 6,105,478

[45] **Date of Patent: *Aug. 22, 2000**

[54] DEVICE FOR OPENING AND FEEDING A ROLL

[75] Inventors: Jean Cestonaro, Marin; David Vuilleumier, Colombier; Pascal Christen, Cortaillod, all of Switzerland

[73] Assignee: Philip Morris Incorporated, New York, N.Y.

[ * ] Notice: This patent is subject to a terminal disclaimer.

[21] Appl. No.: 08/928,368

[22] Filed: Sep. 12, 1997

Related U.S. Application Data

[63] Continuation-in-part of application No. 08/570,278, Dec. 11, 1995.

[51] Int. Cl.[7] ..... B26D 7/14

[52] U.S. Cl. ..... 83/175; 83/454; 83/457; 83/465; 83/466; 83/557; 83/562; 83/563; 83/649; 83/924; 83/949; 242/562

[58] Field of Search ..... 242/562, 523.1, 242/527, 527.7; 131/33, 34, 59; 83/175, 176, 924, 949, 368, 371, 454, 456, 457, 465, 466, 557, 562, 563, 649

[56] References Cited

U.S. PATENT DOCUMENTS

| | | | |
|---|---|---|---|
| 1,914,528 | 6/1933 | Reid | 83/176 |
| 2,747,666 | 5/1956 | Brooks | 83/368 X |
| 3,121,300 | 2/1964 | Rossi | 53/50 |
| 4,007,656 | 2/1977 | Erdody et al. | 83/175 |
| 4,158,417 | 6/1979 | Inoue | 414/412 |
| 4,219,914 | 9/1980 | Bartzick et al. | 83/924 X |
| 4,304,371 | 12/1981 | Rogers | 242/562 |
| 4,344,268 | 8/1982 | Wakamatsu et al. | 53/384 |
| 4,399,729 | 8/1983 | Malinowski et al. | 83/455 |
| 4,435,892 | 3/1984 | Williams | 83/563 X |
| 4,437,223 | 3/1984 | Petros | 29/564 |
| 4,516,451 | 5/1985 | Takeshita et al. | 83/171 |
| 4,579,293 | 4/1986 | Steiniger | 212/55 |
| 4,821,971 | 4/1989 | Watanabe et al. | 242/55 |
| 4,995,406 | 2/1991 | da Silva | 131/105 |
| 5,018,535 | 5/1991 | Da Silva et al. | 131/60 |
| 5,169,082 | 12/1992 | da Silva et al. | 242/58.1 |
| 5,174,183 | 12/1992 | Werner | 83/176 |
| 5,239,903 | 8/1993 | Rosas et al. | 83/456 |
| 5,386,751 | 2/1995 | Dylla et al. | 83/18 |
| 5,467,676 | 11/1995 | Hooper et al. | 83/24 |

FOREIGN PATENT DOCUMENTS

| | | |
|---|---|---|
| 0349350A2 | 3/1990 | European Pat. Off. . |
| 3918552 | 12/1990 | Germany . |
| 2-4627 | 1/1990 | Japan . |
| 2101919A | 1/1983 | United Kingdom . |

*Primary Examiner*—Rinaldi I. Rada
*Assistant Examiner*—Charles Goodman
*Attorney, Agent, or Firm*—Clinton H. Hallman, Jr.; Kevin B. Osborne; Charles E.B. Glenn

[57] ABSTRACT

A device for preparing and opening a roll of a strip of supple material. A flat blade is provided and is inserted from one side of the roll to separate the top layer, which is to be cut, from the lower layers. When the top layer is cut, the cutting portion of the cutting blade comes to rest against the flat. A clamp holds the cut layer and a transferring device handle the cut top layer.

10 Claims, 8 Drawing Sheets

DEVICE FOR OPENING AND FEEDING A ROLL

This is a continuation-in-part of application Ser. No. 08/570,278 filed Dec. 11, 1995.

I. BACKGROUND OF THE INVENTION

A. Field of the Invention

The present invention pertains to a method as well as a device for preparing and opening a roll consisting of a strip of supple material spirally wound in superimposed layers and having a top layer the free end of which is attached to the layer directly beneath it, said roll being mounted on a support shaft and having two parallel sides. The method and the device according to the invention are particularly useful for relatively narrow rolls, namely, those delivering a strip having a maximum width on the order of several centimeters.

B. Description of the Related Art

Various patents, in particular EP-B No. 318,427, EP-B No. 331,634, and EP-B No. 475,886, describe different methods and devices which serve to open a roll consisting particularly of a strip of paper or other material to be fed into a manufacturing machine. These patents generally provide for a cutting blade that is perpendicular to the unwinding direction of the strip and is applied to the top layer of the roll in order to cut it. Since the cutting blade is pressed onto the top layer with a certain force and/or is inserted a certain distance into the roll, several layers of the roll generally are cut simultaneously, with no way of verifying how many layers have been cut.

With these systems, it often happens that the next layer directly below the last cut layer is damaged by the blade, thus making a weak point that could cause the strip to break at that point. A break of this type requires a shutdown of the machine, resulting in a loss of productivity. In certain cases, the top layer of the roll is covered with a protection band made of a material that can be different from that of the roll. In the following description, the top layer of the roll refers either to this protection band, if present, or to the first layer or layers of the roll.

The portion of the second layer onto which the free end of the top layer is glued generally must be removed, for which there must be available auxiliary means of removing it, such that would require that only one layer be cut in some place on said layer not in the immediate proximity of the gluing point.

The application DE-A No. 3,215,355 discloses a related device. The device described therein comprises a support bar on which are mounted a cutting blade and a layer separating blade, both the separating and cutting actions being controlled simultaneously by the movement of the support bar. This device has a number of disadvantages: the design is such that it is impossible to adjust the distance between the support bar and the separating blade, and it is fairly difficult to minimize the height travel setting for the separating blade, as a result of which an excessive number of layers must be cut.

Furthermore, if the force of the separating blade spring decreases after long use, there might not be sufficient compressive force between the support bar and the separating blade, and thus it is impossible that one or several layers between the support bar and the separating blade might not be severed properly.

Since the support bar rests directly on the top layers, the latter are compressed, which makes it more difficult to insert the separating blade. Because the advancing movements of the support bar against the upper layer and those of the separating blade are simultaneous with the cutting movement, the layers to be cut are shifted, causing damage to the layer directly beneath the separating blade and preventing a clean cut of the layers.

This device is not capable of making multiple cutting passes, and the fact that the cutting blade is attached to the support bar makes it difficult to replace a worn blade. Furthermore, this device does not have any means of relaxing the tension of the top layers of the roll if said layers are tightly rolled, in which case it is impossible to use the device.

The documents DE-A No. 3,918,552 and U.S. Pat. No. 4,821,971 describe devices for opening wide rolls. The problems encountered in this case are essentially different from those which the invention proposes to solve. In particular, these devices cannot insert the layer separating blade across the entire width of the roll.

II. OBJECTS OF THE INVENTION

One object of the invention is thus to propose a method of preparing and opening a roll, said method avoiding the disadvantages of the prior art and ensuring that the layer directly below the last cut layer is absolutely intact, even if the top layers of the roll are tightly wound.

Another object of the invention is to propose a device for preparing and opening a roll, said device ensuring that the layer directly below the last cut layer is absolutely intact and avoiding the disadvantages of the prior art, even if the top layers of the roll are tightly wound.

Yet another object of the invention is to propose a device for preparing and opening a roll such that said device that can be associated with a machine that supplies the paper strip required for a machine for the manufacture of cigarettes, including the manufacture or placement of filters.

III. SUMMARY OF THE INVENTION

These objects are achieved by a method and device as described in the instant application. Specifically, this is accomplished by inserting a flat blade from one side of the roll in such a way as to separate the top layer, which is to be cut, from the lower layers. When the top layer is cut, the cutting portion of the cutting blade comes to rest against the flat blade, which protects the layers beneath it.

A clamp for grasping the cut layer and transfer device make it possible to incorporate said device in a cigarette manufacturing line.

IV. BRIEF DESCRIPTION OF THE FIGURES

The invention is described below with reference to the attached drawing, which includes the following figures.

V. DETAILED DESCRIPTION

The following description corresponds to a particular application of the method and the device according to the invention, namely, a cigarette manufacturing line. In this case, the strip of supple material is a strip of paper from which sheets will be taken for wrapping the cigarette rods. A person of the art will know how to adapt the described method and device to other uses, such as the manufacture or placement of filters, or to strips of other materials.

Figure 1:
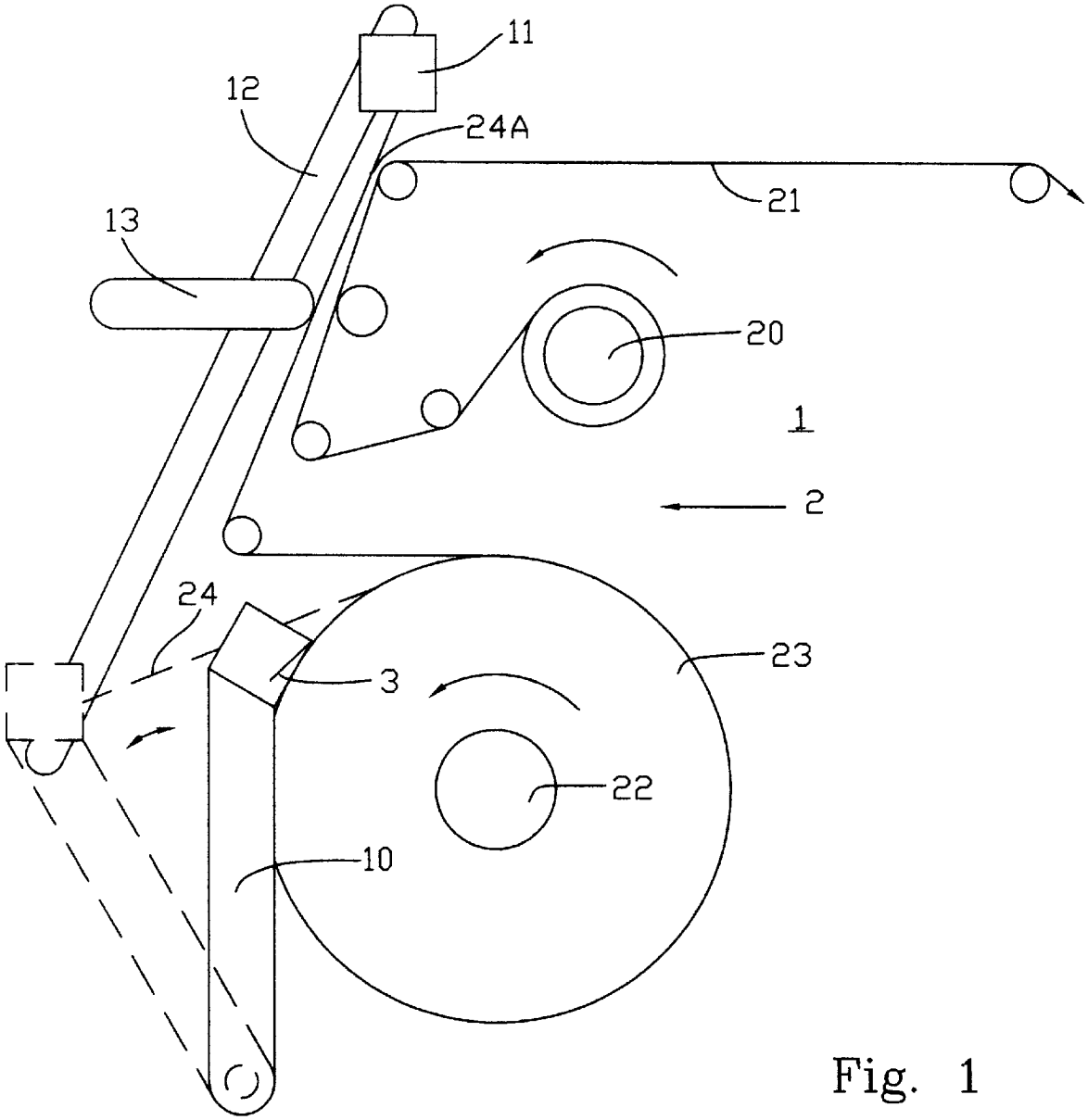
FIG. 1 is a partial front view of a machine capable of joining two strips of paper.

FIG. 1 shows a front view of a machine 1 that feeds a strip of paper to a cigarette machine (not shown) and can join two strips of paper. The feeder 2 of feeding the paper comprises, in this particular exemplary embodiment, a first shaft 20 for unwinding a strip of paper 21 presently in use, said strip being directed toward the cigarette machine by a set of diverting rollers. These means also comprises a second shaft 22 for storing and preparing a full roll 23 of paper.

When the roll delivering the strip 21 is nearly empty, this situation is detected by detectors or feelers (not shown), and the means for preparing and opening the roll 23 are activated, said means comprising, in particular, an oscillating arm 10 at the free end of which is mounted a device 3 for preparing and opening the roll 23, said device to be described in detail below.

The oscillating arm 10 can assume two positions, a ready position shown in dashed lines and a working position, shown in solid lines, when the device 3 is in operation. As will be seen below, the device 3, after having opened the roll 23, is capable of grasping the last cut layer 24. By again actuating the oscillating arm 10, this layer 24, shown in dashed lines, is taken by the device 3, which returns to the ready position.

Then a grasping device 11, known from technical practice and not being part of the invention, travels along a slide 12 to grasp the cut layer 24 and carry it so that over one portion of the path of the strip 21, this new strip, marked 24A, follows a path parallel and close to the strip 21. A joining device, schematically represented as 13, which for example can be of the type described in the patent EP-B No. 682,437, then can be actuated to join the strip 24A with the strip 21.

The above-mentioned characteristics of the paper feeding machine 1 are only presented as an example, since the device for preparing and opening a roll can function on other types of machines.

Figure 2A:
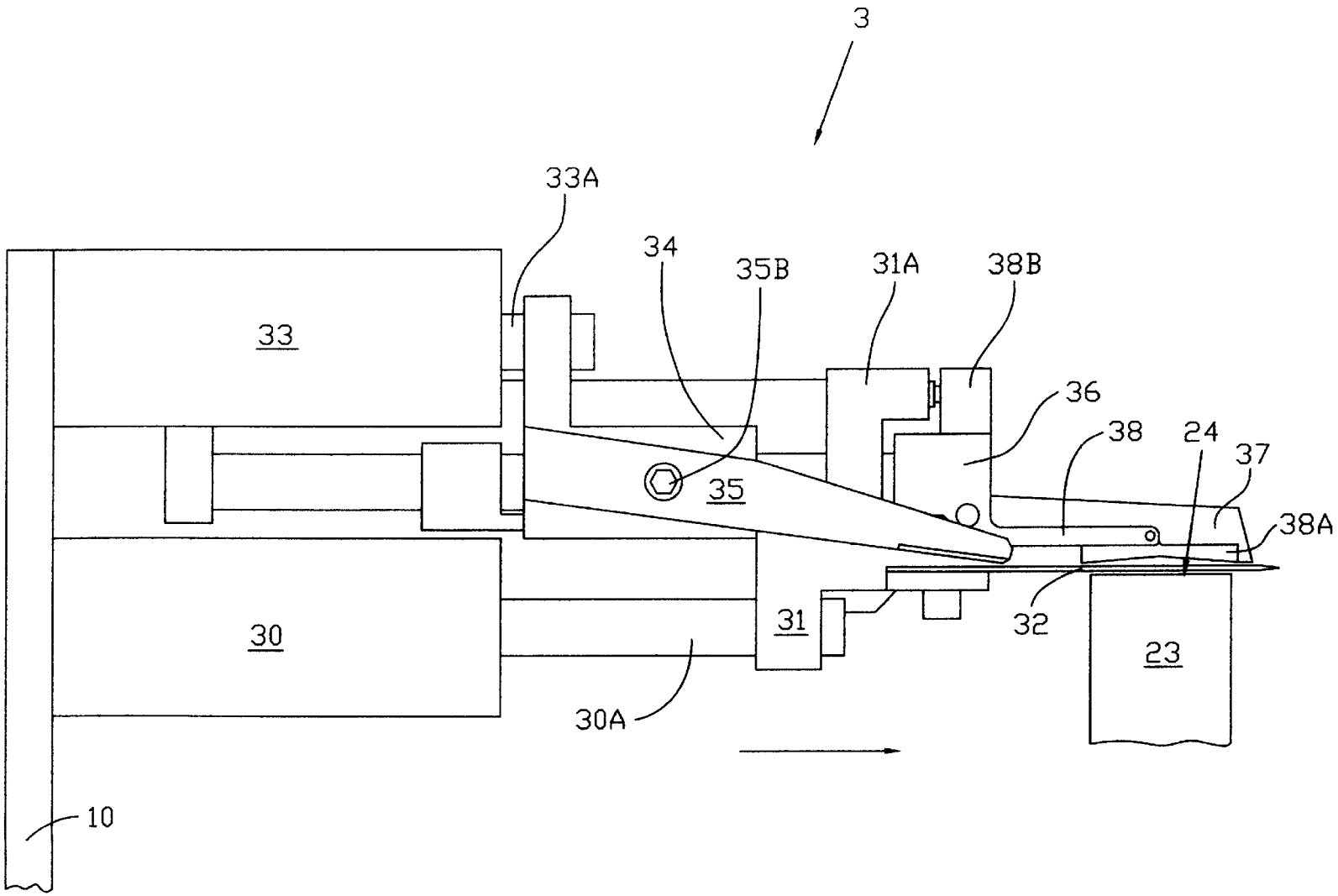
FIG. 2A is a side view of a preparation and cutting device during one step of the method.
Figure 3A:
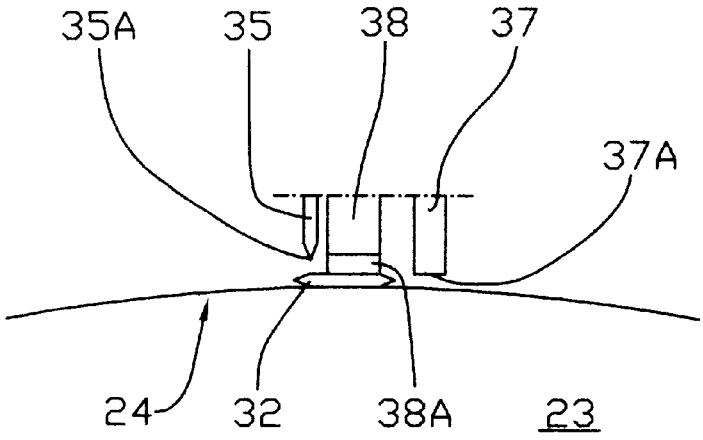
FIG. 3A is a front view of the principal elements of the device during one step of the method.
Figure 3B:
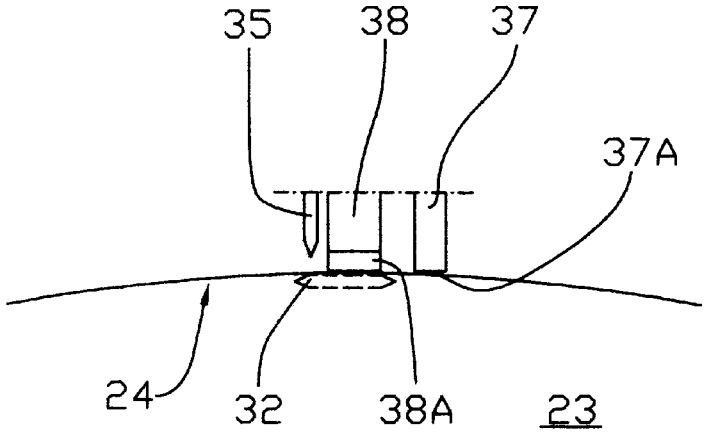
FIG. 3B is a front view of the principal elements of the device during another step of the method.
Figure 3C:
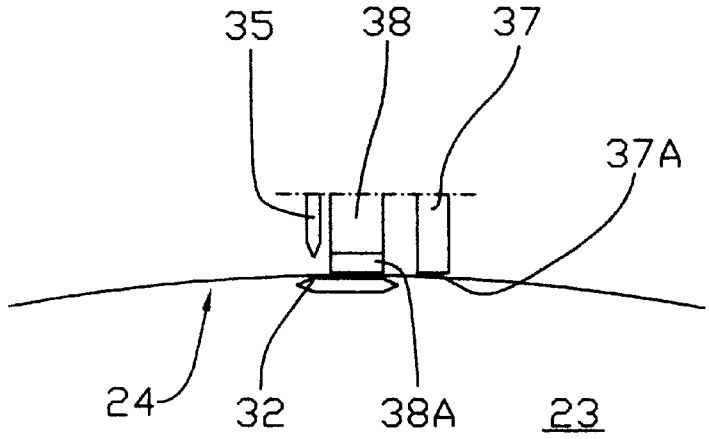
FIG. 3C is a front view of the principal elements of the device during another step of the method.
Figure 3D:
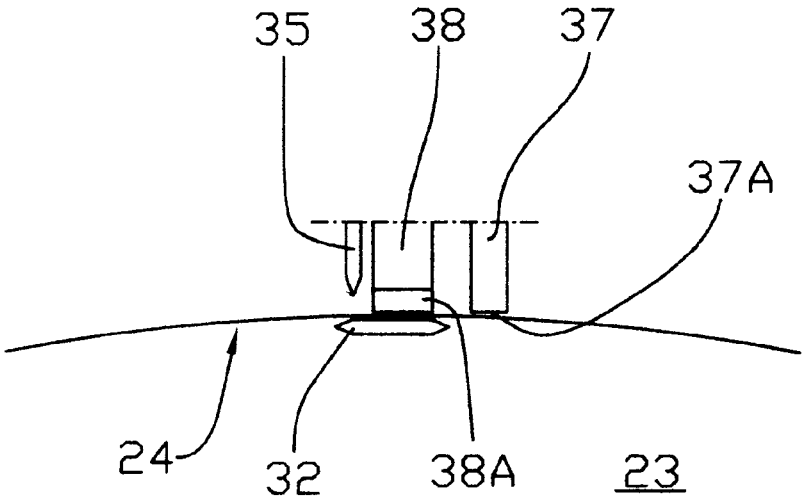
FIG. 3D is a front view of the principal elements of the device during another step of the method.
Figure 3E:
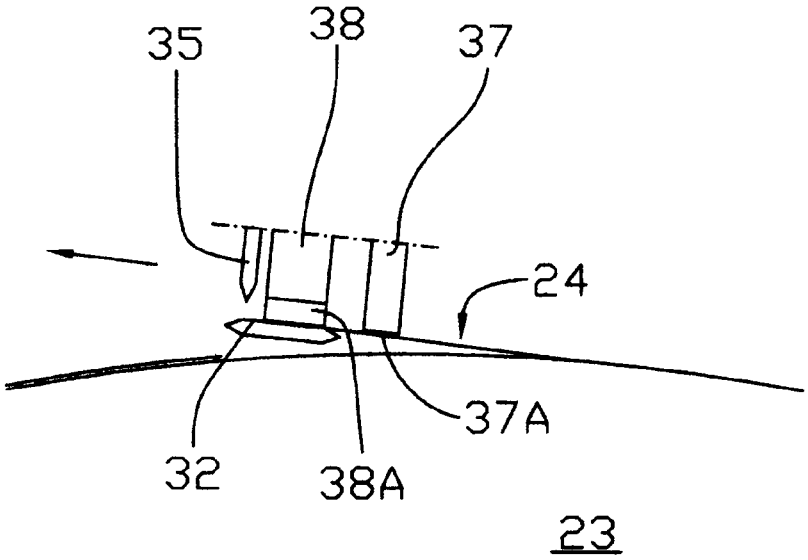
FIG. 3E is a front view of the principal elements of the device during another step of the method.

The above-mentioned preparing and cutting device 3 is shown in side view during four successive steps of the method in FIGS. 2A, B, C, and D, while a part of the same device is shown in front view in FIGS. 3A, B, C, and D, and the device is shown during a fifth step in FIG. 3E.

Preparation is understood to mean any operation performed on the roll 23 before the upper layer 24 of said roll is cut. As can be seen, especially in FIG. 2A and as was mentioned above, the device 3 is mounted on the end of the oscillating arm 10. It consists in particular of a first cylinder 30, the housing of which is attached to the oscillating arm 10 and the rod 30A of which is connected to a first support 31, on one surface of which is attached the end of a flat blade 32.

Figure 2B:
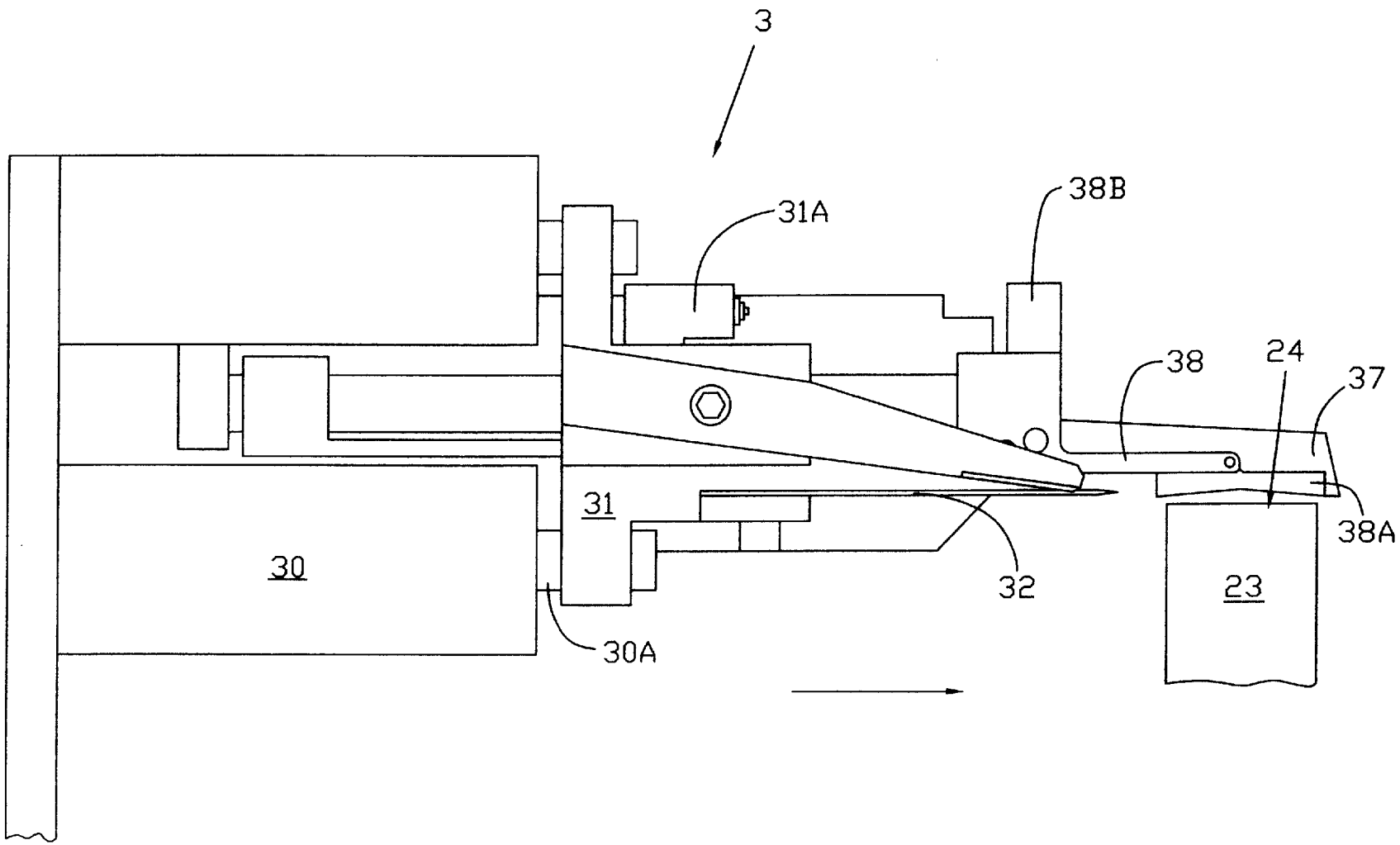
FIG. 2B is a side view of a preparation and cutting device during another step of the method.

A comparison of FIGS. 2A and 2B shows that by actuating the cylinder 30, the flat blade 32 can be positioned either in an extended position as shown in FIG. 2A or in a retracted position as shown in FIG. 2B. In the retracted position, the free end of the blade 32 is before the front surface of the paper roll 23, which in the extended position it is beyond the other surface of the roll 23. The device 3 also comprises a second cylinder 33, the housing of which also is attached to the oscillating arm 10 and the rod 33A of which is connected to a second support 34, to which is attached a cutting blade 35.

Figure 2C:
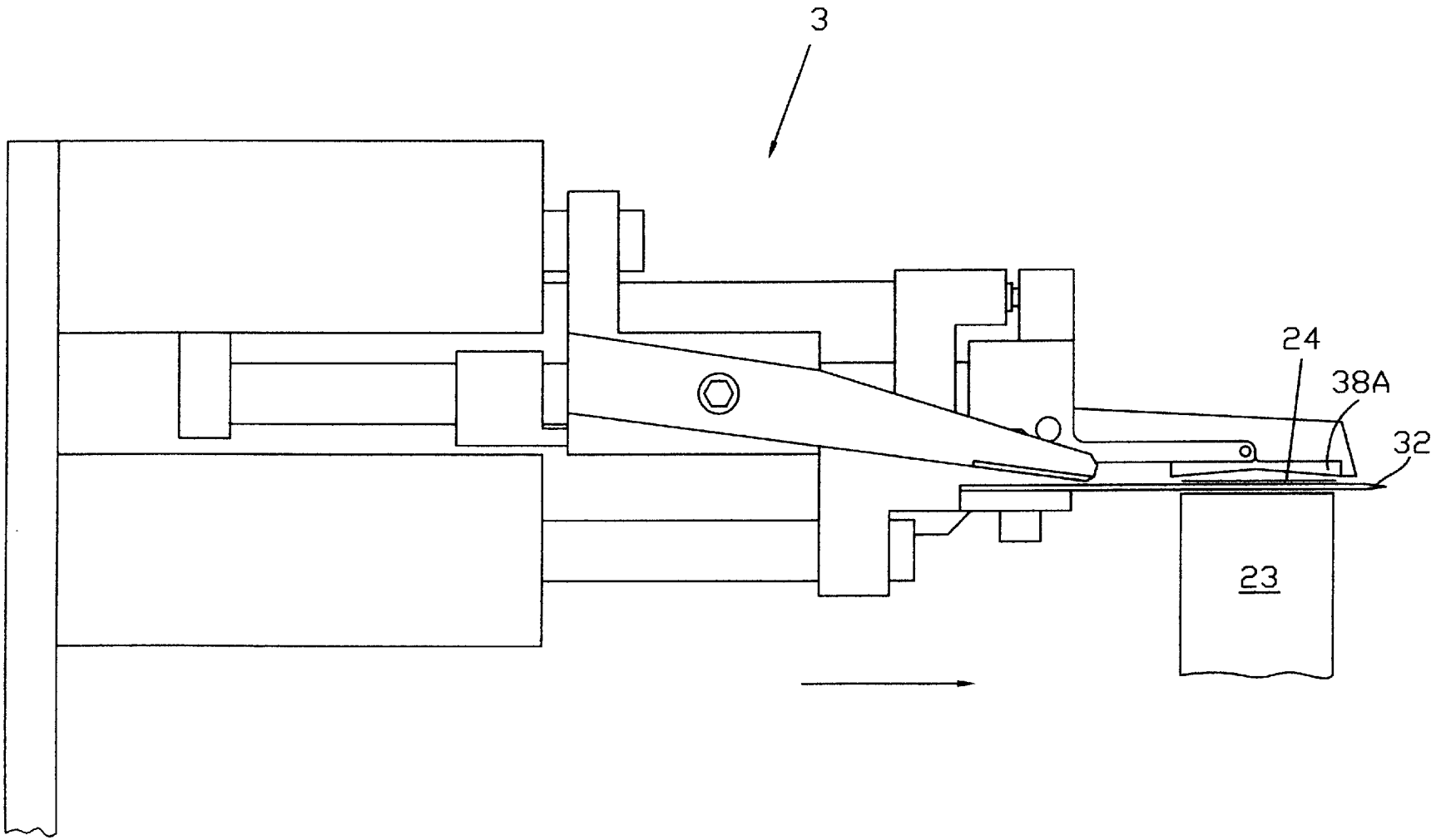
FIG. 2C is a side view of a preparation and cutting device during another step of the method.
Figure 2D:
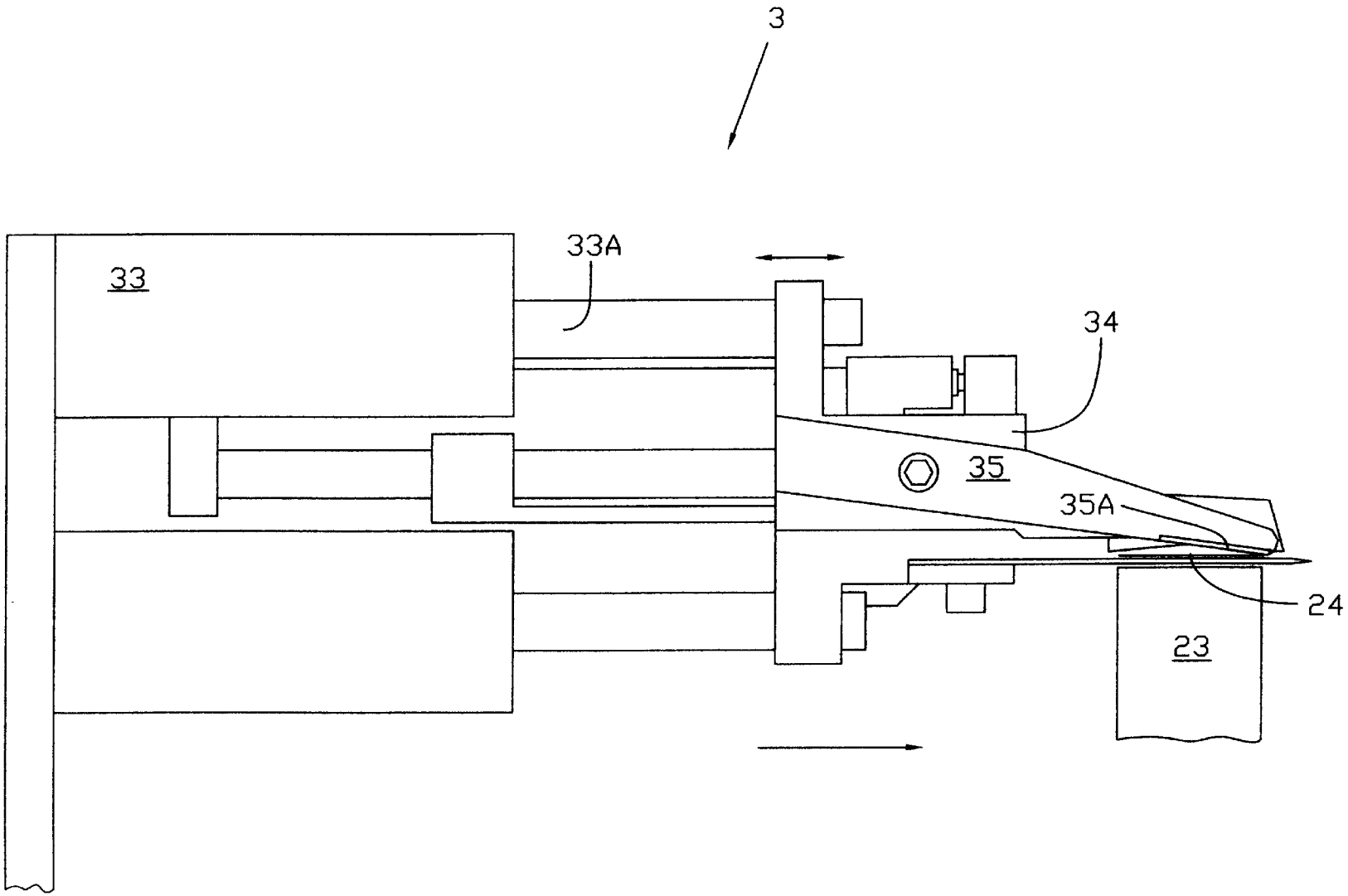
FIG. 2D is a side view of a preparation and cutting device during another step of the method.

A comparison of FIGS. 2A and 2D shows that by actuating the cylinder 33, the cutting end 35A of the blade 35 can be advanced or retracted, respectively, over the entire width of the roll 23 and that a reciprocating motion can be imparted to it. The device 3 also comprises a third support 36 rigidly attached to the oscillating arm 10, said support being extended by a pressing arm 37.

The third support 36 also carries an L-shaped clamping support 38 that pivots about a pin perpendicular to the L. The arm of the support 38 oriented toward the roll 23 carries a clamping plate 38A, while the arm 38B can be actuated by a lever 31A attached to the first support 31. As seen in FIG. 3, the flat blade 32 is thin but relatively wide.

Directly above this blade are the clamping support 38 and the clamping plate 38A, as well as the cutting blade 35. The pressing arm 37 is slightly offset with respect to the flat blade 32, and is on the opposite side of the clamping plate 38A from the cutting blade 35. The distance between the lower pressing surface 37A of the pressing arm 37 and the upper surface of the flat blade 32 is several tenths of a mm, depending on the thickness of the paper or the material comprising the strip and the number of layers to be taken and cut.

Preferably, an adjustment device can be used to adjust this distance in order to cut at least only one layer. The device shown can be provided for setting the correct angular position of the roll 23 on its shaft, so that the top layer 24 is cut in a place relatively far from the place where said layer is glued to the following layer, it thus being possible to minimize the discarded length of paper. This angular position can be set either by the machine operator or by an automatic means. Since the front point of the flat blade 32 is to be inserted between two layers of the roll 23, the shape of this point is adapted to this function.

Now the operation of the device 3 can be described. When the oscillating arm 10 is actuated by a rotating actuator (not shown) to cause the device 3 to press against the roll 23, in the arrangement described here, the cylinder 30 is actuated to extend the flat blade 32. The advancement of the support 31 lowers the clamping plate 38A by the action of the lever 31A on the portion 38A of the support 38. The clamping plate 38A lightly contacts the upper surface of the flat blade 32 in order to keep the latter from bending.

The oscillating arm 10 is actuated until the lower surface of the flat blade 32 contacts a portion of the top layer 24 of the roll 23; when this contact is made, the oscillating arm 10 stops moving. Because of the width of the flat blade 32, the contact between the device 3 and the top layer 24 is very gentle and does not risk damaging or marking this layer, regardless of the quality of the material on the roll 23, since the pressure force depends essentially on an adjustable residual pressure in the rotating actuator that actuates the oscillating arm 10.

This first step of the method is shown in FIGS. 2A and 3A. During the next step shown in FIGS. 2B and 3B, the cylinder 30 is actuated to retract the blade 32. The device 3, which no longer presses against the top layer 24, then continues moving very slightly toward the roll 23 until the lower pressing surface 37A of the pressing arm 37 in turn comes in contact with the top layer 24. When the lever 31A disengages from the support 38, the clamping plate 38A rests freely on the layer 24 without pressure.

Then, as shown in FIGS. 2C and 3C, the flat blade 32 is extended again. Because of the slight movement of the device 3 toward the roll 23 during the previous step, the plane of the flat blade 32 is located just below one or several top layers 24 of the roll 23. The flat blade 32 thus is inserted from the side of the roll below this top layer or layers and spans the entire thickness of the roll 23. Because of the extension of the flat blade 32, the clamping plate 38A is again pressed against said blade, thus strongly clamping the layer or layers 24 between the upper surface of the flat blade 32 and the lower surface of the clamping plate 38A.

Figure 4A:
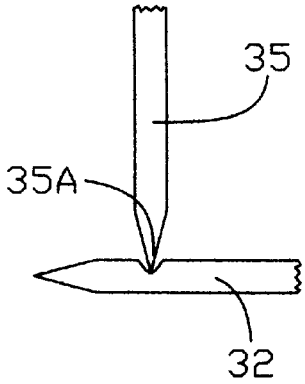
FIG. 4A is a partial views of a detail of the preceding device according to FIG. 3A.
Figure 4B:
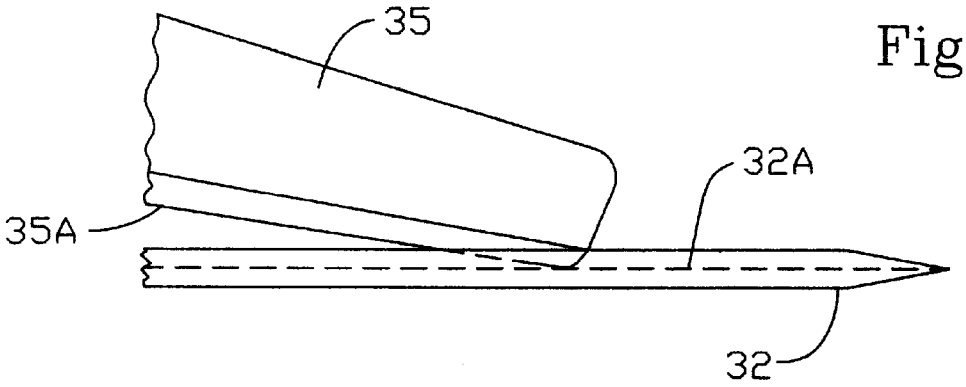
FIG. 4B is a partial view of a detail of the preceding device according to FIG. 3A.

The cutting operation is shown in FIGS. 2D and 3D, where the cylinder 33 has been actuated to drive the cutting blade 35 in order to cut the layer or layers 24 above the flat blade 32. As shown in FIGS. 4A and 4B, the flat blade 32 can have a groove 32A that is parallel to the longitudinal axis and corresponds to the track made by the sharpened portion 35A of the cutting blade 35 on the flat blade 32. This grove 32A guides the sharpened portion 35A, keeping it from deviating from its rectilinear path during the reciprocating cutting movement.

Because of this flat blade, which acts as a protective shield, the layers of the roll 23 directly beneath the flat blade 32 cannot be damaged by the sharpened portion 35A of the cutting blade 35. Depending on the quality of the material and the number of layers to be cut, the reciprocating movement of the cutting blade 35 might be repeated one or several times. For the next step shown in FIG. 3E, the cutting blade 35 is retracted and the flat blade 32 remains extended, thereby causing the clamping plate 38A to clamp the layer or layers 24.

The oscillating arm 10 is again actuated to retract the device 3 from the roll 23, the latter then being rotated by the traction applied to the top layer or layers 24 or by an auxiliary means not shown. The cut end of the strip is carried to undergo the treatment described previously with regard to FIG. 1. In the case where several layers were cut, only the last remains attached to the roll 23, and the cut segments of the upper layers prior to the last layer are eliminated by known means.

The cylinders 30 and 33 are preferably pneumatic or hydraulic double-acting cylinders, although other means of actuating the flat blade 32 and the cutting blade 35 could be provided. Also to be noted in FIG. 2A is that the cutting blade 35 is attached to the support 34 by the screw means 35B, which permit the adjustment of the position of said blade in relation to the flat blade 32, as well as the rapid replacement of a worn blade 35.

A notable aspect of the method is the ability to bring the flat blade 32 to the exact position where it can be easily slid beneath the top layer 24 of the roll 23. In the above-described arrangement, this positioning is achieved in two steps: the device 3 is brought forward after the flat blade 32 has been extended and then said blade 32 is retracted so that the pressing arm 37 presses on the top layer 24.

Other means could be provided to accomplish this step of the method: if there is sufficient space on the device, the pressing arm 37 could be made wide enough so that it could be placed directly in contact with the top layer 24 when the oscillating arm 10 is moved, or feeling means separate from the oscillating arm 10 or even detectors could be provided to determine the necessary stopping position for the oscillating arm 10.

During the different steps of the above-described method, except the last, the roll 23 generally remains stationary, with no rotational movement on its shaft. However, during the step of inserting the flat blade 32, in order to facilitate this insertion between the layers of the roll, said roll could be provided with a slow rotational movement, preferably in the direction opposite the normal unwinding direction, so that during this rotational movement, the flat blade 32 tends to be pushed upward by the spiral winding of the roll layers.

Figure 5:
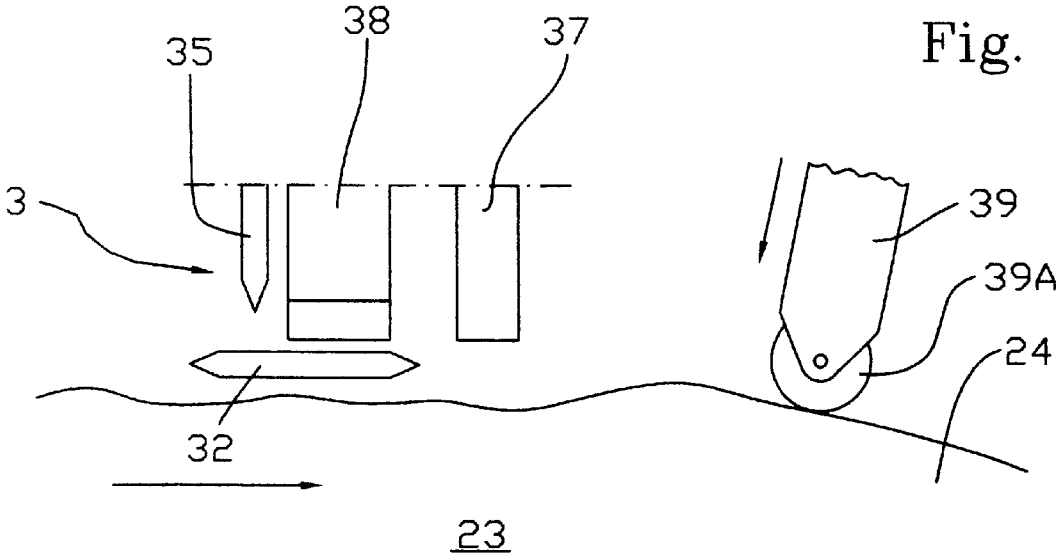
FIG. 5 is a perspective view of a device that complements the apparatus in FIGS. 1–4B.

In the case where the layers of the roll 23 are so tightly wound that it is difficult to insert the flat blade 32, the top layers can be loosened slightly before the device 3 is brought against the top layer 24, as shown in FIG. 5. For this, the device can include also a radial pressing device 39 having a roller 39A on the end close to the roll. The pressing device 39 is independent of the device 3 and is located ahead of the latter with respect to the normal unwinding direction of the roll 23. Before the device 3 comes into contact with the top layer 24, the pressing device 39 is pressed with a certain pressure radially in relation to the roll 23 by means of a pneumatic or hydraulic actuator (not shown), said pressure being transmitted to the top layers through the roller 39A.

Then by making the roll 23 pivot in the direction, as indicated by the arrow in FIG. 5, opposite to its normal unwinding, the top layers 24 are loosened or relaxed, thus facilitating the insertion of the flat blade 32.

Thus, the method and the device according to the invention, which are easily adaptable to a cigarette manufacturing line, assure that a clean cut is obtained in the top layer of a full roll without damaging the layer directly below it. The above-described device is of relatively simple design and requires few means of monitoring or actuation, which makes it particularly reliable and inexpensive.

As was mentioned above, the method and the device described herein also can be used to prepare and open a roll of a material other than paper, and a person of the art will be able to adapt the described means to this end if necessary. Furthermore, the above-described preferential arrangement of the invention is only one possible arrangement, and variations of one or another of the elements could be conceived by a person of the art without going beyond the scope of the invention.

Having described the invention as above, we claim:

1. An apparatus for preparing and opening a narrow roll of a strip of a supple material wound in superimposed spiral layers and having a width, lower layers, and a top layer, said top layer having a surface and a free end which is attached to the layer directly beneath said top layer, said roll being mounted on a support shaft and having two parallel sides, said apparatus comprising a flat blade attached to a support, said flat blade having an upper surface and a lower surface, a support transfer device which transfers the support and flat blade to an extended position completely intersecting the width of the roll or to a retracted position not intersecting the width of the roll, a compression device comprising a pressing arm having a surface directed toward a portion of the surface of the top layer, a cutting device comprising a cutting blade arranged to travel in a reciprocating movement over the entire width of the roll and creating a cut in said top layer, said cut having a depth being limited by the flat blade serving as a protective shield for the lower layers, a clamp for clamping said top layer between said clamp and said flat blade, and a positioning device which moves the flat blade, the support, the support transfer device, the compression device, the cutting device, and the clamp such that the flat blade is brought into contact with the top layer.

2. An apparatus according to claim 1, wherein when said flat blade is in said extended position said lower surface acts as a pressing surface when contact is made between the apparatus and the top layer of the roll.

3. An apparatus according to claim 1, wherein the strip of supple material has a thickness and there is a distance between the pressing surface of the pressing arm and the upper surface of the flat blade equal to at least the thickness of one layer of the strip of supple material.

4. An apparatus according to claim 1, wherein the support transfer device for transferring the flat blade, comprises a pneumatic or hydraulic cylinder.

5. An apparatus according to claim 1, wherein the apparatus further comprises a guide for the cutting blade.

6. An apparatus according to claim 5, wherein the guide for the cutting blade comprises a longitudinal groove in the upper surface of the flat blade.

7. An apparatus according to claim 1, wherein the clamp is actuated during the travel of the flat blade.

8. An apparatus as claimed in claim 1, further comprising a cutting blade actuator.

9. An apparatus as claimed in claim 8, wherein the cutting blade actuator is a hydraulic or pneumatic cylinder.

10. An apparatus as claimed in claim 1, wherein the maximum width of the roll is several centimeters.

* * * * *